US008813398B2

(12) United States Patent
Dickert

(10) Patent No.: US 8,813,398 B2
(45) Date of Patent: Aug. 26, 2014

(54) THREE-DIMENSION GIFT CARD ASSEMBLY

(75) Inventor: Philip M. Dickert, Hawthorn Woods, IL (US)

(73) Assignee: Sears Brands, L.L.C., Hoffman Estates, IL (US)

( * ) Notice: Subject to any disclaimer, the term of this patent is extended or adjusted under 35 U.S.C. 154(b) by 903 days.

(21) Appl. No.: 12/180,247

(22) Filed: Jul. 25, 2008

(65) Prior Publication Data

US 2010/0018090 A1 Jan. 28, 2010

(51) Int. Cl.
*G09F 1/04* (2006.01)
*G09F 1/06* (2006.01)
*B42D 5/02* (2006.01)

(52) U.S. Cl.
CPC ..... *G09F 1/06* (2013.01); *B42P 2241/24* (2013.01); *B42D 2037/10* (2013.01); *B42P 2241/12* (2013.01); *B42D 5/027* (2013.01)
USPC ..... 40/124.08; 235/380

(58) Field of Classification Search
USPC ..... 235/380; 40/124.08
See application file for complete search history.

(56) References Cited

U.S. PATENT DOCUMENTS 2,736,115 A * 2/1956 James ..... 40/312
4,784,314 A * 11/1988 Penick ..... 229/116.3
4,968,540 A * 11/1990 Linsenbigler ..... 428/5
5,402,236 A 3/1995 Brown et al.
5,650,209 A 7/1997 Ramsburg et al.
5,667,247 A 9/1997 Ramsburg et al.
5,760,381 A 6/1998 Stich et al.
5,918,909 A 7/1999 Fiala et al.
5,958,174 A 9/1999 Ramsberg et al.
6,088,943 A * 7/2000 Ramirez ..... 40/661.09
6,698,116 B2 3/2004 Waldron
7,024,807 B2 4/2006 Street
7,111,736 B2 * 9/2006 Petter ..... 206/768
7,293,701 B2 11/2007 Halbur et al.
2005/0246230 A1 11/2005 Murray
2006/0186196 A1 8/2006 Schultz et al.
2006/0231609 A1 10/2006 Lazarowicz et al.
2007/0246548 A1 10/2007 Schultz et al.
2008/0149709 A1 6/2008 Boyd et al.

* cited by examiner

*Primary Examiner* — Charles A Fox
*Assistant Examiner* — Shin Kim
(74) *Attorney, Agent, or Firm* — McAndrews, Held & Malloy, Ltd.

(57) ABSTRACT

A gift card assembly includes a substrate, a gift card, and a card carrying member interposed between the substrate and the gift card. The card carrying member is releasably attached to the substrate and releasably attached to the gift card. The card carrying member resiliently or movably carries the gift card relative to the substrate such that the gift card is allowed to be spaced from the substrate when the gift card assembly is in a displayed configuration (which thereby provides a three-dimensional effect to the gift card assembly) and is allowed to achieve a position adjacent to the substrate when the gift card assembly is in a stowed configuration.

5 Claims, 3 Drawing Sheets

THREE-DIMENSION GIFT CARD ASSEMBLY

BACKGROUND

In the art, assemblies for gift cards, pre-paid cards, stored-value cards, etc. (uniformly referred to hereinafter as "gift cards") are well known. By way of example, gift card assemblies are described in each of U.S. Pat. Nos. 5,918,909; 5,958,174; 5,760,381; 5,667,247; 5,650,209; 5,402,236; and 7,293,701 as well as each of U.S. Published Application Nos. 2008/0149709; 2007/0246548; 2006/0231609; 2006/0186196; and 2005/0246230. For the sake of brevity, the disclosure within each of these patents and published applications is incorporated herein by reference in its entirety.

SUMMARY

The following describes a three-dimensional gift card assembly. The gift card assembly generally includes a substrate or backing, a gift card, and a card carrying member interposed between the substrate and the gift card. The card carrying member is releasably attached to the substrate and releasably attached to the gift card. More particularly, the card carrying member may resiliently or movably carry the gift card relative to the substrate such that the gift card is allowed to be spaced from the substrate when the gift card assembly is in a displayed configuration (which thereby provides a three-dimensional effect to the gift card assembly) and is allowed to achieve a position adjacent to the substrate when the gift card assembly is in a stowed configuration.

In the illustrated example, the card carrying member, constructed from a paper, cardboard, plastic, or similar material, is provided with at least two folds which define at least a first portion, a second portion, and a third portion. The first portion is releasably attached to the substrate, the second portion is releasably attached to the gift card, and the third portion is disposed intermediate the first portion and the second portion. Owing to the folds, the third portion is moveable relative to the first portion and the second portion during any transition between the displayed configuration and the stowed configuration.

A better understanding of the objects, advantages, features, properties and relationships of the subject gift card assembly will be obtained from the following detailed description and accompanying drawings which set forth an illustrative embodiment and which are indicative of the various ways in which the principles of the invention may be employed.

BRIEF DESCRIPTION OF THE DRAWINGS

For a better understanding of the gift card assembly described hereinafter reference may be had to the following drawings in which.

DETAILED DESCRIPTION

Figure 1:
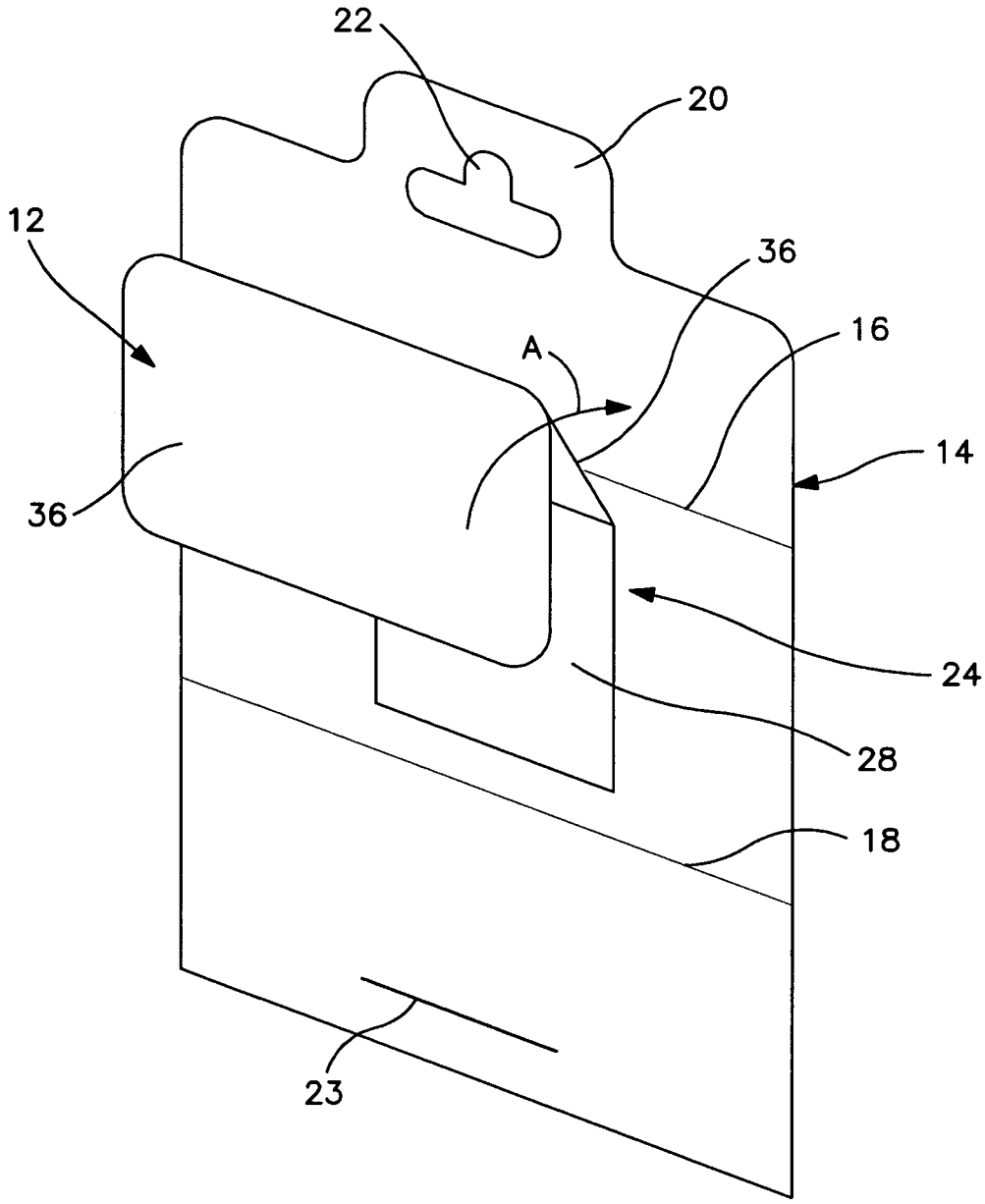
FIG. 1 illustrates an exemplary gift card assembly constructed in accordance with the inventive concepts.

Referring now to the figures, a gift card assembly 10 is now described. As illustrated in FIG. 1, the gift card assembly 10 includes a gift card 12 which is supported upon a substrate 14. Generally, the substrate 14, which also may be called a backing, comprises a single layer or multiple layers of paper or plastic material, for example, generally in the form of a relatively stiff but bendable/flexible card. In the illustrated example, the substrate 14 is a tri-fold substrate defined by fold lines 16 and 18 about which substrate 14 is foldable. In FIG. 1 the substrate 14 is illustrated in an unfolded or open configuration which is the normal retail display configuration. When the substrate 14 is folded, with the card 10 being captured therein, a tab 20 or the like can be mated with a slot 23 or the like to maintain the substrate in the folded or closed configuration. The tab 20 or substrate 14 may also be provide a hook, opening, or the like 22 to allow the gift card assembly 10 to be displayed on a peg or the like at a merchant location, such as at the point of sale (POS). It will be understood that the substrate 14 may be constructed using other materials and/or fold arrangements and may include any form of indicia, e.g., graphics and/or text, without departing from the scope of the invention.

The gift card 12 supported upon the substrate 14 may be any type of card such as, but not limited to, gift cards, stored-value cards, financial-transaction cards, reservation cards, pre-paid cards, loyalty cards, merchandise return cards, employee cards, frequency cards, etc. (collectively "gift card"). In the event that the gift card 12 is, for example, a card used by a merchant to issue a spending credit to a customer, the merchant would typically provide the card in exchange for money received, merchandise returned or other consideration in a conventional manner, e.g., the gift card 12 would be "loadable" or "chargeable" with monetary value that the customer can use or give to another individual. In such a case, a record of the monetary balance on the card may be maintained on a database, other electronic or manual record-keeping system, or, in the case of "smart" cards, for example, on a chip or other electronics or devices on the card itself and the gift card 12 would generally include a feature, such as a barcode, magnetic strip, etc. having data that represents an account number or otherwise serves to link the gift card 12 to the database or other electronic or manual storage device or system as is also conventional.

The gift card 12 is further releasably secured to the substrate 14. More particularly, with reference to FIGS. 1-3, the gift card 12 is releasably secured to a card carrying member 24 which, in turn, is releasably secured to the substrate 14. An adhesive or an adherence layer is provided between the card carrying member 24 and the substrate 14 and the adhesive or adherence layer functions to loosely adhere a first portion 28 of the card carrying member 24 to an area 26 of the substrate 14. Similarly, an adhesive or an adherence layer is provided between the gift card 12 and the card carrying member 24 and the adhesive or adherence layer again functions to loosely adhere a second portion of the card carrying member 32 to a back side 34 of the gift card 12. In this manner, indicia carried upon a front side 36 of the gift card 12 will be visible when the gift card assembly 10 is displayed at the merchant location.

Figure 2:
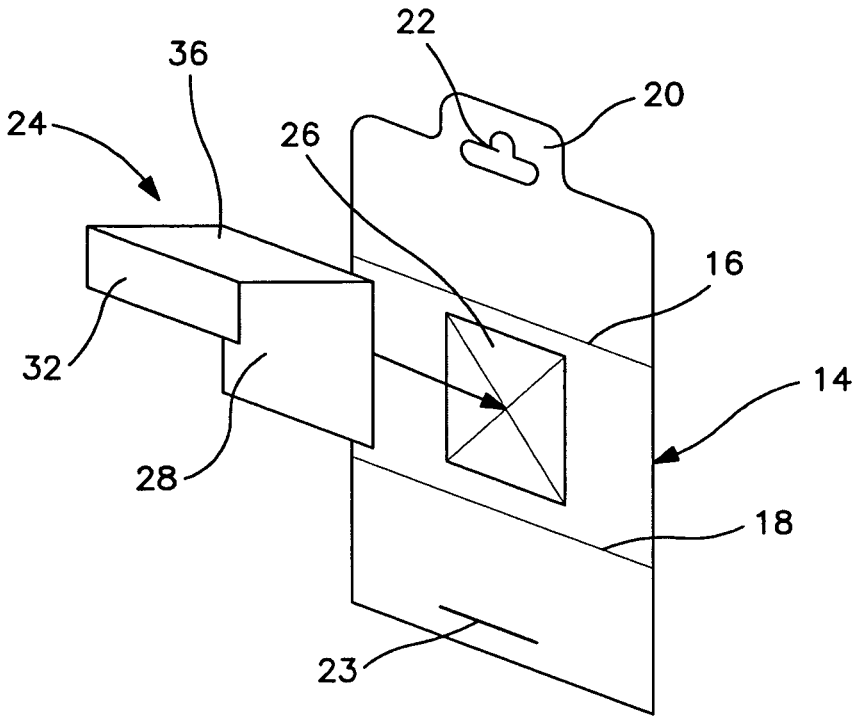
FIG. 2 is an exploded view illustrating the substrate and gift card carrying member of the exemplary assembly of FIG. 1.
Figure 3:
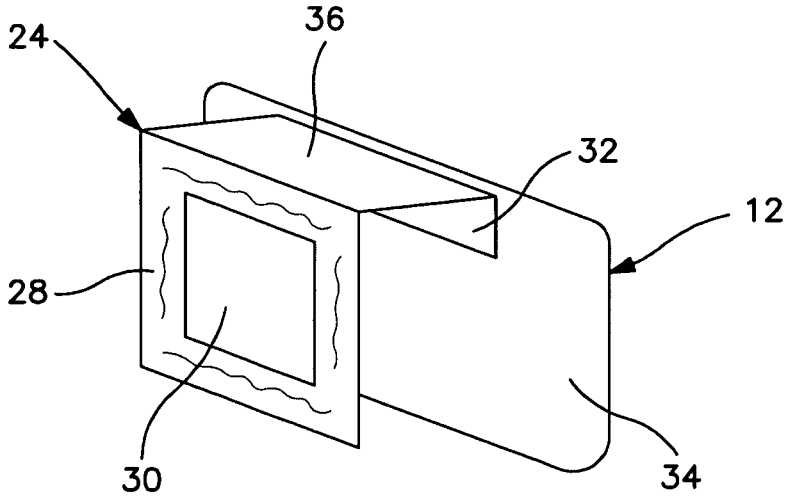
FIG. 3 illustrates the gift card and gift card carrying member of the exemplary assembly of FIG. 1.

To allow the gift card assembly 10 to have a three-dimensional like appearance when displayed in the area of the retail store, the card carrying member 12 is preferably provided with at least two folds as particularly illustrated in FIGS. 2 and 3. In the illustrated example, the folds function to define the first portion 28 of the card carrying member 24 that is releasably attached to the substrate 14, the second portion 32 of the card carrying member 24 that is releasably attached to the gift card 12, and an intermediate portion 36 of the card carrying member 24 that functions to space the gift card 12 from the substrate 14 when the gift card assembly 10 is in a displayed configuration. More particularly, in the displayed configuration, the folds and the stiffness of the material of the card carrying member 34 cooperate such that the third portion 36 of the card carrying member 24 is disposed at generally a right angle to the first portion 28 of the card carrying member 24 thus causing the gift card 12 to be spaced from the substrate 14 while the second member 32 of the card carrying member 24 is also disposed at generally a right angle to the third portion 36 of the card carrying member 24 thus causing the gift card 12 to be generally parallel to the substrate 14. It will be understood that the described angles and orientations of the portions of the card carrying member 24 and the gift card 10 relative to the substrate 14 need not be exactly attained and that variations are acceptable so long as, within the displayed configuration, the gift card 10 appears to be extending from and not flatly attached to the substrate 14. Similarly, it will be appreciated that more than two folds can be provided to the card carrying member 24 and/or a resilient material could be used in lieu of the paper/cardboard material described with the objective of causing the gift card 10 to be extended from the substrate 14 when in the displayed configuration still being met. It may also be desired that the arrangement and material of the card carrying member 24 be such that, when multiple gift card assemblies are stacked and forced together upon a peg or the like at the display area of the retail store, shipped or packaged together, etc., i.e., the gift card assembly 10 is in a stowed configuration, the gift card 12 will be moveable to a position that is generally flush against or adjacent to the substrate 14 so as to conserve space in the manner illustrated by line A in FIG. 1.

Figure 4:
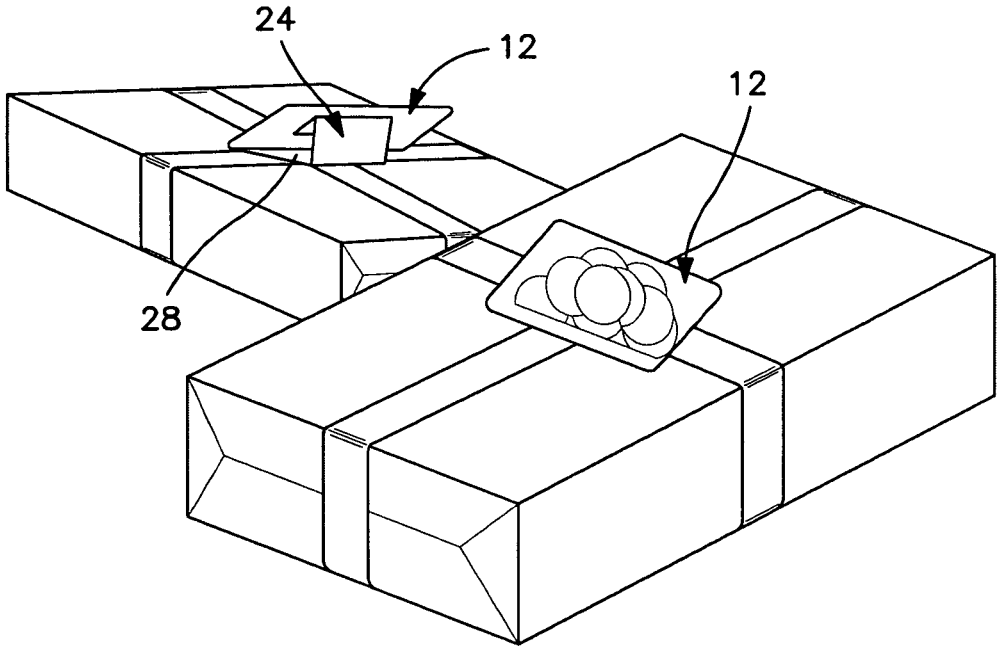
FIG. 4 illustrates the gift card and gift card carrying member of the exemplary assembly of FIG. 1 removed from the substrate and attached to a gift.

To allow the card carrying member 24, and accordingly, the gift card 12 to be attached to a gift or like when removed from the substrate 14, as illustrated in FIG. 4, the first portion 28 of the card carrying member 24 may also include an adhesive portion 30. By way of example, the adhesive portion 30 may be in the form of double sided tape that is applied to the first portion 28 of the card carrying member 24 where the side of the tape facing the substrate 14, which is to be attached to the gift, is provided with a removable covering. In the example illustrated in FIG. 3, the adhesive portion 30 would be in addition to the adhesive or adhesion layer that allows the card carrying member 24 to be removably attached to the substrate. In this manner, the card carrying member 24 and, accordingly, the gift card 10, could be removed from the substrate, the cover could be removed from double sided tape, and the first portion of the card carrying member 24 and, accordingly, the gift card 10 could be attached to a gift in the propped-up manner illustrated in FIG. 4. As additionally illustrated in FIG. 4, the gift card 10 can be provided within indicia, such as the picture of a bow, to provide further three-dimensional ornamentation to the present as desired.

While a specific embodiment of a gift card assembly has been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A gift card assembly, comprising:

a substrate having an opening for accepting a peg of a merchandising display;

a gift card; and a card carrying member interposed between the substrate and the gift card; wherein the card carrying member is loosely adhered to the substrate and is loosely adhered to the gift card and wherein the card carrying member is arranged and configured such that the gift card is spaced from the substrate and substantially parallel to the substrate when the gift card assembly is in a displayed configuration as a result of the substrate being hung via use of the opening from the peg of the merchandising display.

2. The gift card assembly as recited in claim 1, wherein the card carrying member comprises a first portion, a second portion, and a third portion, the first portion being loosely adhered to the substrate, the second portion being loosely adhered to the gift card, and the third portion being disposed intermediate the first portion and the second portion and causing the gift card to be spaced from the substrate in the displayed configuration, wherein the card carrying member comprises two folds that define the first portion, the second portion, and the third portion, wherein, in the displayed configuration, the third portion of the card carrying member is generally disposed at ninety degrees relative to the first portion of the card carrying member and the third portion of the card carrying member is generally disposed at ninety degree relative to the second portion of the card carrying member to thereby position the gift card substantially parallel to the substrate, and further comprising a covered, double sided tape attached to the first portion of the card carrying member intermediate the first portion of the card carrying member and the substrate when the card carrying member is loosely adhered to the substrate wherein a covering of the double sided tape is removeable upon removal of the card carrying member from the substrate to thereby allow the gift card and card carrying member to be attached to a gift.

3. The gift card assembly as recited in claim 1, further comprising a covered, double sided tape attached to the card carrying member intermediate the card carrying member and the substrate when the card carrying member is loosely adhered to the substrate wherein a covering of the double sided tape is removable upon removal of the card carrying member from the substrate to thereby allow the gift card and card carrying member to be attached to a gift.

4. A gift card assembly, comprising:

a substrate having an opening for accepting a peg of a merchandising display;

a gift card; and a card carrying member interposed between the substrate and the gift card; wherein the card carrying member is loosely adhered to the substrate and loosely adhered to the gift card and wherein the card carrying member moveably carries the gift card relative to the substrate such the gift card is spaced from the substrate and substantially parallel to the substrate when the gift card assembly is in a displayed configuration as a result of the substrate being hung via use of the opening from the peg of the merchandising display and the gift card is positioned adjacent to the substrate when the gift card assembly is in a stowed configuration.

5. The gift card assembly as recited in claim 4, wherein the card carrying member comprises a pair of fold which define a first portion, a second portion, and a third portion, wherein the first portion is loosely adhered to the substrate, the second portion is loosely adhered to the gift card, and the third portion is disposed intermediate the first portion and the second portion, wherein, in the displayed configuration, the third portion of the card carrying member is generally disposed at ninety degrees relative to the first portion of the card carrying member and the third portion of the card carrying member is generally disposed at ninety degree relative to the second portion of the card carrying member to thereby position the gift card substantially parallel to the substrate, and further comprising a covered, double sided tape attached to the first portion of the card carrying member intermediate the first portion of the card carrying member and the substrate when the card carrying member is loosely adhered to the substrate wherein a covering of the double sided tape is removable upon removal of the card carrying member from the substrate to thereby allow the gift card and card carrying member to be attached to a gift.

* * * * *